US005875751A

United States Patent [19]

Strauss et al.

[11] Patent Number: 5,875,751

[45] Date of Patent: Mar. 2, 1999

[54] DEVICE FOR VARYING VALVE TIMING IN AN INTERNAL COMBUSTION ENGINE

[75] Inventors: Andreas Strauss, Herzogenaurach; Joachim Dietz, Frensdorf, both of Germany

[73] Assignee: INA Walzlager Schaeffler oHG, Germany

[21] Appl. No.: 85,488

[22] Filed: May 27, 1998

[30] Foreign Application Priority Data

Jun. 13, 1997 [DE] Germany ..... 197 24 989.2

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160, 161

[56] References Cited

U.S. PATENT DOCUMENTS 5,377,639 1/1995 Nakadouzono et al. ..... 123/90.17
5,738,056 4/1998 Mikame et al. ..... 123/90.17
5,775,279 7/1998 Ogawa et al. ..... 123/90.17
5,797,361 8/1998 Mikame et al. ..... 123/90.17

FOREIGN PATENT DOCUMENTS 19541769 5/1997 Germany .
196 30 174 A1 1/1998 Germany ..... 123/90.17

*Primary Examiner*—Weilun Lo
*Attorney, Agent, or Firm*—Bierman, Muserlian and Lucas

[57] ABSTRACT

A device (1) for varying the valve timing in an internal combustion engine having a hydraulically displaceable annular piston (9) comprises a locking piston (15) arranged adjacent to a pressure chamber (14) which is situated in front of the annular piston (9) and to facilitate a displacement of the locking piston (15) in its uncoupling direction by hydraulic medium, a vent passage (27) leads out of a pressure chamber (26) situated axially behind the locking piston (15) for evacuating the air collected in this pressure chamber (26) into the open.

4 Claims, 1 Drawing Sheet

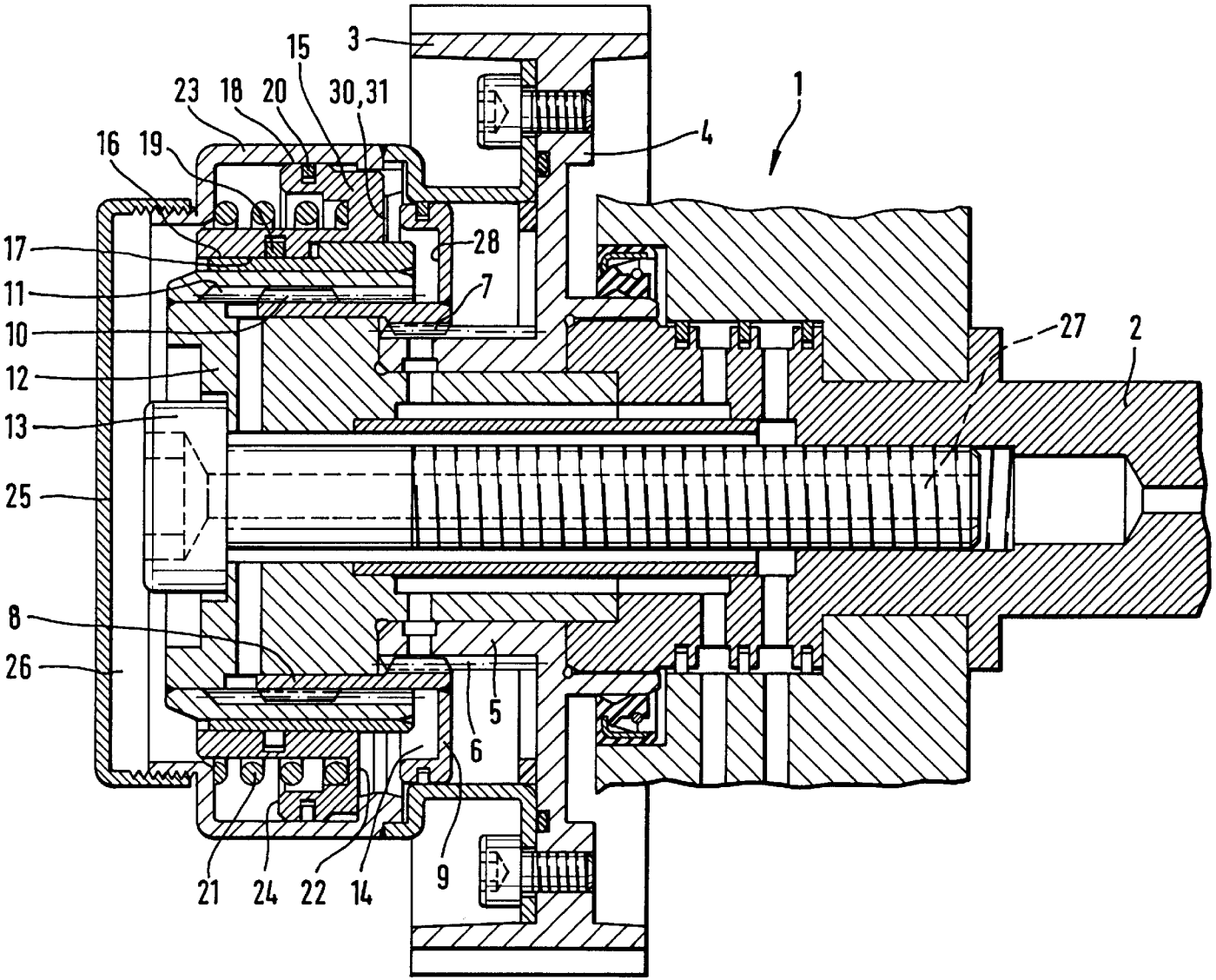
1
2
27
4
3
28
7
30,31
15
20
18
23
19
16
17
11
10
12
13
25
8
26
5
6
9
14
22
24
21

DEVICE FOR VARYING VALVE TIMING IN AN INTERNAL COMBUSTION ENGINE

FIELD OF THE INVENTION

A device for varying valve timing in an internal combustion engine, which device is arranged within a valve control gear of at least one camshaft mounted in a cylinder head.

BACKGROUND OF THE INVENTION

In a device of the above type known from DE-PS 29 09 803, the problem arises on starting of the internal combustion engine that the adjusting piston moves at a high speed into a position of maximum displacement in which its repeated abutting is accompanied by a considerable amount of noise. This is due to the fact that when the engine has been turned off, the hydraulic medium contained in the device gradually escapes therefrom so that the adjusting piston is no longer sufficiently supported hydraulically. Due to the torsional vibrations of the camshaft, the adjusting piston, because of a lack of hydraulic support, is displaced into an end. position on re-starting of the engine, with the already mentioned, considerable noise generation. This state prevails during the period of time between the ignition of the engine and the filling of the pressure chambers, that is to say, for a few seconds after the engine has been started.

OBJECTS OF THE INVENTION

It is an object of the invention to create a device of the above type in which the aforesaid drawbacks are eliminated and the start rattling is avoided, particularly with the use of simple means i.e., with only slight structural modifications.

This and other objects and advantages of the invention will become obvious from the following detailed description.

SUMMARY OF THE INVENTION

The device of the invention for valve timing in an internal combustion engine which is arranged within a valve control gear of is at least one camshaft mounted in a cylinder head is characterized in that:

the device comprises a belt pulley driven by a timing belt and having a radial flange, within the device is arranged an adjusting element such as an annular piston comprising at least one axial extension and being displaceable in at least one axial direction by a servo means such as a hydraulic medium, said annular piston, as viewed in axial direction, defining a hydraulic medium pressure chamber at least on one side, the axial extension comprises a first and a second gear section, the first gear section cooperating with a first gearing of a ring rigidly connected to the radial flange, while the second gear section meshes with a second gearing provided on a driven unit which is connected rotationally fast to the camshaft, the device is delimited radially and at one end by a pot which is fixed on the belt pulley or on the radial flange thereof and seals the device to prevent a leakage of hydraulic medium to the exterior, a locking piston which may optionally have an annular configuration is arranged opposite an end of the annular piston which is adjacent to the hydraulic medium pressure chamber, the locking piston is coupled by a longitudinal guide radially inwardly to the driven unit or radially outwardly to the pot and, with decreasing hydraulic medium pressure or in the absence of hydraulic medium pressure in the hydraulic medium pressure chamber, the locking piston can be displaced towards the annular piston by the force of a separate loading means such as a spring so as to interlock by a coupling means arranged on an end of the locking piston facing the hydraulic medium pressure chamber with a complementary, second coupling means provided on the pot, or, if the longitudinal guide is arranged radially outwardly, with a coupling means provided on the driven unit, and a further pressure chamber situated axially between a second end of the locking piston remote from the hydraulic medium pressure chamber and a bottom of the pot comprises at least one vent passage leading at least indirectly into the open.

With the aforesaid means of the invention, the start rattling known from the state of the art is avoided in a simple manner. As soon as a drop of pressure occurs in the hydraulic medium pressure chamber after the internal combustion engine has been switched off, the locking piston is displaced by the force of its loading means such as a coil spring, towards the annular piston, and the coupling means of the locking piston come to interlock with complementary coupling means of the pot or of the driven unit, as the case may be. An axial displacement of the annual pressure piston is only possible when the internal combustion engine has been re-started and the pressure chamber or chambers have been filled with hydraulic medium, that is to say, when the annular piston has a substantial hydraulic support.

Besides this, the means of the invention guarantee that a highly effective hydraulic force is available for application to the locking piston for the displacement thereof from its coupled position into its uncoupled position. This is achieved by the fact that the further pressure chamber situated axially between an end of the locking piston remote from the hydraulic medium pressure chamber and a bottom of the pot possesses a vent passage leading into the open. Thus, when the hydraulic medium pressure chamber is being filled with hydraulic medium after re-ignition of the internal combustion engine, the locking piston does not have to perform compression work in the further pressure chamber, or the compression work required is extremely small. At the same time, an end of the locking piston facing the hydraulic medium pressure chamber is configured to have a relatively large hydraulic surface area so that only slight hydraulic pressure is required for displacing the locking piston into its uncoupled position.

According to a further feature of the invention, the vent passage is arranged along a screw which connects the driven unit to the camshaft. However, further vent passages, for example such arranged directly on the pot, are also conceivable. Undesired hydraulic medium collecting in the further pressure chamber situated axially between the pot and the locking piston can also be drained off in a simple manner through this vent passage(s).

The pot which is advantageously connected to the radial flange and surrounds the device properly speaking, is necessary in the case of a device associated to a belt pulley because, in contrast to a chain, a driving belt of a belt pulley should, under no circumstances, come into contact with the hydraulic medium.

BRIEF DESCRIPTION OF THE DRAWING

The invention is described more closely below with reference to the attached sole figure which is a cross-section through a device of the invention.

DETAILED DESCRIPTION OF THE DRAWING

The Figure shows a device 1 for varying the valve timing in an internal combustion engine as known, per se, in the technical field with regard to its basic structure and mode of functioning. The device 1 is arranged in front of one end of a camshaft 2 and comprises a belt pulley 3 driven by a timing belt, not shown. The belt pulley 3 comprises a radially inner radial flange 4 which is firmly connected to (in the present case, integral to) a ring 5. On its radially outer surface, the ring 5 comprises a first gearing 6 (helical gearing) which meshes with a first gear section 7 of an axial extension 8 which forms a part of an annular piston 9. The axial extension 8 further comprises, on its radially outer surface, a second gear section 10 which engages a complementary and radially inner gearing 11 of a driven unit 12. The driven unit 12 is rotationally fixed on the camshaft 2 by a screw 13.

The annular piston 9 possesses an axially outer pressure chamber 14 for hydraulic medium and adjacent to this pressure chamber 14 is disposed a locking piston 15 which is configured in the present case as an annular piston. This locking piston 15 is coupled radially inwardly to the driven unit 12 by a longitudinal guide 16 needing no further description in the present context. Radially inner and outer peripheral surfaces 17, 18 of the locking piston 15 are provided with sealing means 19, 20 which seal the pressure chamber 14 to the largest possible extent in axially outward direction. The locking piston 15 is biased axially inwards by a separate loading means 21 such as a spring (for the function of the locking piston 15, see introduction of the specification). When hydraulic medium is fed into the pressure chamber 14 i.e., when hydraulic medium comes to be situated in front of the annular piston 9 and an end 22 of the locking piston 15, the locking piston 15 is displaced axially outwards i.e., away from the camshaft 2.

A pot shaped housing 23 fixed on the radial flange 4 and sealing the device 1 against leakage of hydraulic medium, delimits a further pressure chamber 26 between its bottom 25 and an end 24 of the locking piston 15 remote from the pressure chamber 14. To obtain the highest possible hydraulically effective force of the hydraulic medium in front of the end 22 of the locking piston 15 facing the pressure chamber 14, according to the invention, the further pressure chamber 26 is provided with a vent passage 27 extending through the screw 13 at least indirectly into the open. Thus, the air which has collected in the pressure chamber 26 is no longer compressed during the hydraulically effected displacement of the locking piston 15 in the uncoupling direction (towards the bottom 25), but evacuated. At the same time, a surface area of the end 22 of the locking piston 15 is configured to be relatively large so that only small hydraulic forces are required for displacing the locking piston 15.

It may be remarked in passing that the end 22 of the locking piston 15 comprises a coupling means 30 which it is not necessary to describe here. In the position of displacement of the locking piston 15 shown in the upper half of the figure, this coupling means 30 engages a complementary coupling means 31 of the pot shaped housing 23. Thus the belt pulley 3 is prevented from rotating relative to the camshaft 2 till the pressure chamber 26 has been refilled with hydraulic medium.

Various modifications of the device of the invention may be made without departing from the spirit or scope thereof and it is to be understood that the invention is intended to be limited only as defined in the appended claims.

What we claim is:

1. A device (1) for varying valve timing in an internal combustion engine, said device (1) is arranged within a valve control gear of a camshaft (2) mounted in a cylinder head, characterized in that the device (1) comprises a belt pulley (3) driven by a timing belt and having a radial flange (4), within the device (1) is arranged as an adjusting element an annular piston (9) comprising an axial extension (8) and being axially displaceable by a servo means, said annular piston (9) defining a hydraulic medium pressure chamber (14) at least on one side of the piston, the axial extension (8) comprises a first and a second gear Section (7, 10), the first gear section (7) cooperating with a first gearing (6) of a ring (5) rigidly connected to the radial flange (4), while the second gear section (10) meshes with a second gearing (11) provided on a driven unit (12) which is fixedly connected to the camshaft (2), the device (1) is delimited radially and at one end by a pot shaped housing (23) which is fixed on the radial flange (4) thereof and seals the device (1) to prevent a leakage of hydraulic medium, locking piston (15) having an annular configuration is arranged opposing an end (28) of the annular piston (9) which is adjacent to the hydraulic medium pressure chamber (14), the locking piston (15) is coupled by a longitudinal guide (16) radially inwardly to the driven unit (12) or radially outwardly to the pot shaped housing (23) and, with decreasing hydraulic medium pressure or in the absence of hydraulic medium pressure in the hydraulic medium pressure chamber (14), the locking piston (15) can be displaced towards the annular piston (9) by a force of a spring means (21) so as to interlock by a coupling means (30) arranged on an end (22) of the locking piston (15) facing the hydraulic medium pressure chamber (14) with a complementary, second coupling means (31) provided on the pot shaped housing (23), and a further chamber (26) situated axially between a second end (24) of the locking piston (9) remote from the hydraulic medium pressure chamber (14) and a bottom (25) of the pot shaped housing (23) comprises at least one vent passage (27) to prevent compression of air thereof.

2. A device of claim 1 wherein the vent passage (27) enters the camshaft (2) at one end thereof and extends axially along the camshaft (2).

3. A device of claim 2 wherein the vent passage (27) is an integral part of a screw (13) which connects the driven unit (12) to the camshaft (2).

4. A device of claim 1 wherein the end (22) of the locking piston (15) facing the hydraulic medium pressure chamber (14) has a surface area which is about 0.5 times a surface area of the end (28) of the annular piston (9) situated opposite thereto.

* * * * *